United States Patent [19]

Karbo

[11] 4,149,045

[45] Apr. 10, 1979

[54] AUTOMATIC CONTROLLER

[75] Inventor: Richard S. Karbo, Newport Beach, Calif.

[73] Assignee: Hydro-Rain, Inc., San Juan Capistrano, Calif.

[21] Appl. No.: 827,610

[22] Filed: Aug. 25, 1977

[51] Int. Cl.[2] ..... H01H 19/00; H01H 43/04

[52] U.S. Cl. ..... 200/37 R; 200/25; 200/29

[58] Field of Search ..... 200/11 G, 11 K, 24, 200/25, 28, 29, 37 R, 37 A

[56] References Cited

U.S. PATENT DOCUMENTS

| | | | |
|---|---|---|---|
| 2,203,944 | 6/1940 | De Haes | 200/37 R |
| 2,281,888 | 5/1942 | Snyder | 200/37 R |
| 2,533,877 | 12/1950 | Chikan | 200/37 R |
| 3,746,806 | 7/1973 | Jespersen | 200/37 R |
| 3,752,943 | 8/1973 | Wang | 200/37 A X |
| 3,828,200 | 8/1974 | Gerry | 200/37 R X |

*Primary Examiner*—James R. Scott
*Attorney, Agent, or Firm*—Gordon L. Peterson

[57] ABSTRACT

An automatic controller comprising a supporting structure, a plurality of adjustable contacts, and a selector mounted for movement on the supporting structure for sequentially engaging each of the contents. The adjustable contacts are mounted on the supporting structure for movement relative to each other along a path from a relatively stacked condition to a relatively fanned out condition. In the fanned out condition, each adjustable contact can project beyond at least one adjacent adjustable contact a variable amount so that the extent of exposure of each adjustable contact can be adjusted. The selector sequentially engages the exposed portions of the contacts to sequentially make and break a plurality of circuits.

15 Claims, 8 Drawing Figures

AUTOMATIC CONTROLLER

BACKGROUND OF THE INVENTION

Various operations in industry, agriculture, and elsewhere must be caused to occur automatically in an established sequence. One example is in irrigation where irrigation valves must be opened and closed in a known sequence. This sequence must be repeated periodically, such as every other day at prescribed times during the day.

Automatic sprinkler controllers which perform the above-described control functions are known and available commercially. One such automatic controller slowly rotates a selector at constant speed over a series of contacts. Engagement of the selector and one of the contacts completes a circuit to one or more of the irrigation valves to open such valve. The valves remain open for as long as the selector engages the associated contact.

This type of controller is reliable; however, it possesses several disadvantages. First, because of the construction of the controller, there are gaps between adjacent contacts. When the selector is in one of these gaps between contacts, no circuit is completed to an irrigation valve, and consequently, no irrigating takes place. This gap or deadband is undesirable because it is normally desirable to complete the irrigation process as rapidly as possible and without any interruption.

This prior art controller does allow the length of time for irrigation at each station to be varied. This is accomplished by using a wedge-shaped contact which can be moved progressively into, or out of, the path of movement of the selector to thereby vary the length of time of engagement between the selector and the contact. A station can be skipped entirely by removing the contact from the path of the selector. However, to the extent that the watering time at a station is diminished, the deadband increases. In other words, if the watering time at a station is decreased by ten minutes, the deadband, or nonwatering time, for the entire irrigation system is increased by ten minutes.

In an effort to overcome these disadvantages, two motors have been utilized on the controller. One motor drives the selector at a relatively slow speed over the contacts and the second motor drives the selector at a higher speed through the gaps. This controller is more expensive because of the additional motor and the additional controls for the motor. In addition, this controller only reduces the gaps, but does not eliminate them.

One form of controller which apparently has solved the deadband problem is substantially entirely electronic. However, this controller is very expensive.

SUMMARY OF THE INVENTION

The present invention provides an automatic controller of the electromechanical type which entirely eliminates gaps or deadbands between stations. The gaps can be eliminated even though the watering time at one or more of the stations is reduced. Furthermore, the gaps are eliminated even when a station is skipped entirely.

The controller of this invention has a total cycle time which can be divided up in virtually any desired manner among the several stations. For example, if seven stations are provided, one of the stations may use three fourths of the total cycle time, and the remaining one fourth of the cycle time can be divided up among the remaining six stations. By way of contrast, with a seven station prior art controller, each station would get no more than one seventh the total cycle time. All of these advantages are obtained in a relatively simple and low-cost controller which has improved accuracy particularly for the shorter cycle times.

These advantages are obtained, at least in part, by mounting the adjustable contacts on a supporting structure for movement relative to each other along a path from a relatively stacked condition to a relatively fanned-out condition. In the fanned-out condition, each adjustable contact can project beyond at least one adjacent adjustable contact a variable amount. Accordingly, the extent of exposure of each adjustable contact can be adjusted.

The selector and the adjustable contacts are moved relative to each other along a path to sequentially bring the selector into engagement with the exposed portions of the contacts. This sequentially selects the circuits having the exposed portions. Because the length of the exposed portions can be varied, the length of time each of the circuits is selected is correspondingly adjusted.

Either the selector and/or the adjustable contacts can be moved along the path. However, to facilitate implementation and to reduce cost of the unit, preferably only the selector moves along the path.

To eliminate gaps, the exposed portions of the contacts should be contiguous. By permitting the adjustable contacts to be moved from a stacked condition to a relatively fanned-out condition, the exposed portions are inherently contiguous, and so there are no gaps between stations. A station can be entirely skipped by retaining the associated contact in the stack so that no portion thereof is exposed to the selector along the path. Even when this is done, no gaps are introduced between stations.

This stacking and fanning out of the contacts also enables the total cycle time to be divided up in virtually any desired way. For example, in an extreme case, all of the contacts, except one, may be retained within the stack and have no exposed portion, and the remaining contact may be extended so that its exposed portion uses up all, or any portion of, the entire cycle time.

The controller requires only a single motor which drives the selector along the path at substantially constant speed. The controller may also include the necessary additional controls for repeating the cycle automatically at selected periods. Alternatively, manual reset for repeating the cycle can be utilized.

The adjustable contacts can be constructed in various different ways. The contacts should, however, be electrically insulated from each other and some indicia must be provided in order to inform the operator as to the selected cycle time for each of the stations. Although this can be accomplished in different ways, it can be advantageously done utilizing a series of contact assemblies. Each of the contact assemblies may include a contact carrier of electrical insulating material, one of the above-described adjustable contacts, and timing indicia. The carrier insulates the contact carried thereby from one of the other contacts. The timing indicia is also on the carrier, and it indicates the cycle time for one of the other adjacent contacts.

The contact assemblies can be advantageously stacked between the supporting structure and a mask mounted on the supporting structure. The mask insulates the portions of the contacts which are not to be exposed to the selector. The mask may also be used, if desired, to assist in mounting the contact assemblies. In this latter case, the mask has an aperture therein extending along the path of movement of the selector to allow the selector to engage the exposed portions of the contacts. The mask may also be used to carry the timing indicia for one of the contacts. With this arrangement, one of the contact assemblies does not have timing indicia forming a portion thereof.

Although many different mechanical arrangements are possible, the supporting structure may be in the form of a plate having a slot therein through which the timing indicia is visible to the operator. Each of the contact assemblies may also include a tab projecting through the slot to facilitate manual adjustment of the cycle time for each of the stations.

The path along which the selector is driven by the motor may be arcuate or linear. However, there are certain implementation advantages to rotating the selector along a circular path and utilizing arcuate contacts.

The automatic controller of this invention can be used to sequence many operations. Although the controller is described herein with reference to the sequencing of irrigation valves, this is purely illustrative.

The invention, together with further features and advantages thereof, may best be understood by reference to the following description taken in connection with the accompanying illustrative drawing.

DESCRIPTION OF THE PREFERRED EMBODIMENT

Figure 1:
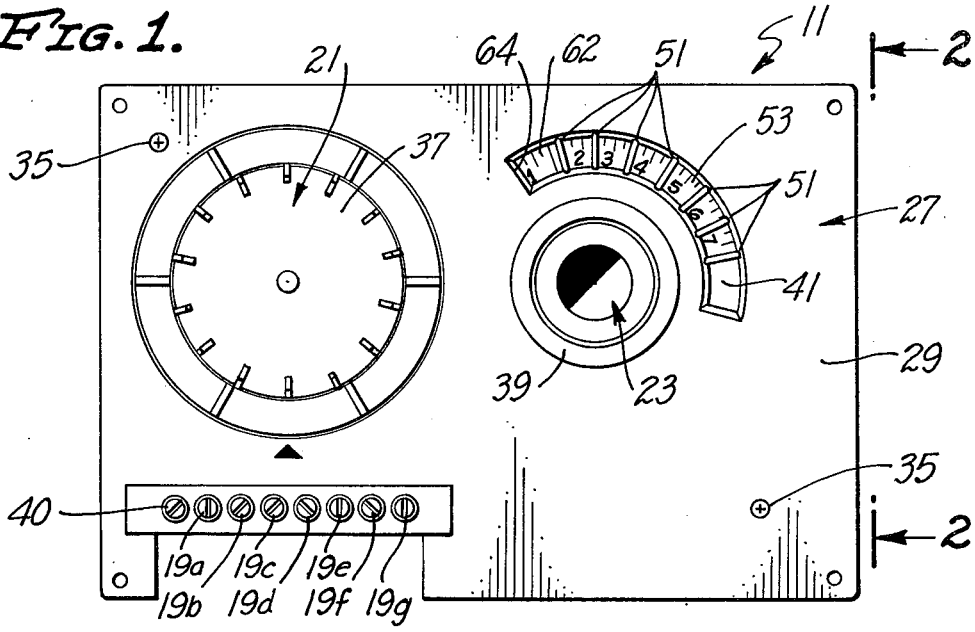
FIG. 1 is a top plan view of an automatic controller constructed in accordance with the teachings of this invention.
Figure 1A:
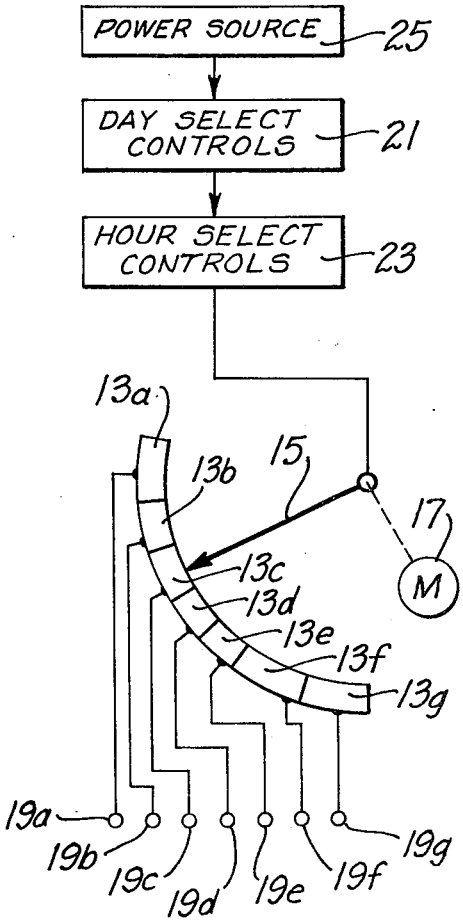
FIG. 1A is a schematic view of the controller.

FIG. 1A shows an automatic controller 11 which includes adjustable contacts **13*a*–13*g*, a selector 15 for engaging the exposed portions of the contacts, and a motor 17. The contacts 13*a*–13*g* are coupled respectively to terminals 19*a*–19*g* for controlling the operation of equipment at corresponding stations. The motor 17 drives the selector 15 continuously at constant speed along a circular path with the selector sequentially engaging the exposed portions of the contacts 13*a*–13*g*. As shown in FIG. 1A, the lengths of the exposed portions of the contacts 13*a*–13*g*** may be different.

The controller 11 also includes conventional day-select controls 21 and hour-select controls 23 interposed in series between the selector 15 and a source 25 of electrical energy. The day-select controls 21 are, in effect, a switch which closes and remains closed only for the selected days of the cycle. The hour-select controls are, in effect, a switch which closes only during the selected hours of each day. Because the controls 21 and 23 are in series between the source 25 and the selector 15, electrical energy is provided to the selector 15 only during the selected days and at the selected hours. Accordingly, a circuit is established from the source 25 to the selected one of the contacts **13*a*–13*g* only during the selected days and hours. The controls 21 and 23 can be eliminated, in which event, a circuit is established between the source 25 and the contacts 13*a*–13*g* each time the selector 15** engages the selected contacts.

The terminals **19*a*–19*g* may be coupled to whatever external device is to be controlled by the controller 11. For example, each of the terminals 19*a*–19*g* may be coupled to one or more electrically operable sprinkler valves (not shown) which open whenever a circuit is completed from the source 25** to the selected one of the terminals and closes when that circuit is open.

Figure 2:
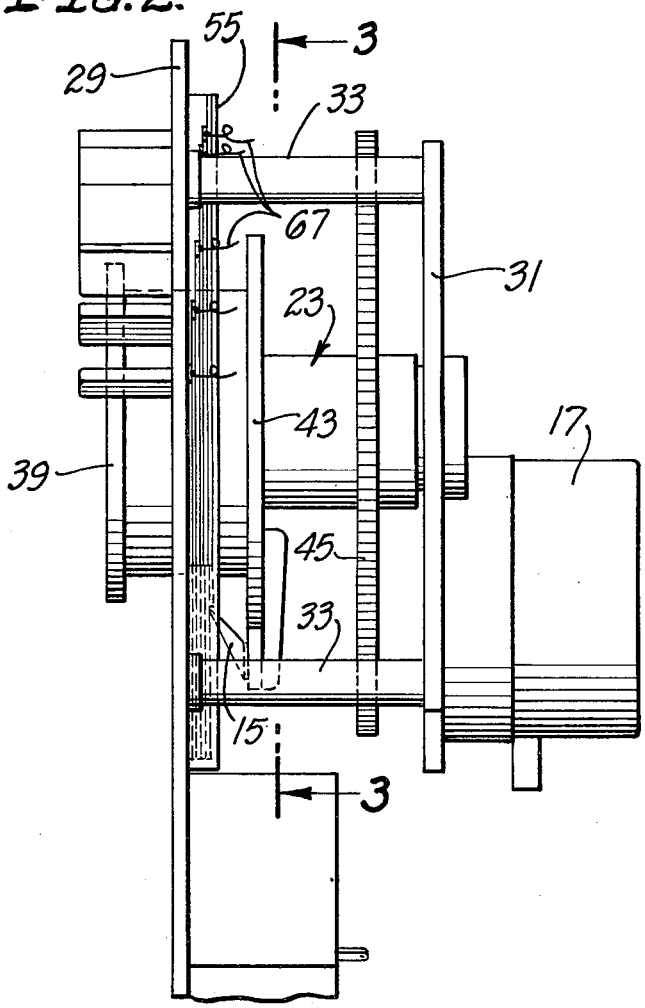
FIG. 2 is a side elevational view taken generally along line 2—2 of FIG. 1.

FIGS. 1–6 show a specific embodiment of the controller 11. With reference to FIGS. 1 and 2, the controller 11 includes a supporting structure 27 which, in the embodiment illustrated, includes a front plate 29 and a back plate 31 held apart by spacers 33 and held together by screws 35 which extend into the spacers. The day-select controls 21 and the hour-select controls 23 are mounted between the plates 29 and 31 in a known manner. The controls 21 and 23 have manually adjustable dials 37 and 39, respectively, for making the day and hour selections. The controls 21 and 23 may be of conventional construction and per se form no part of the present invention. For example, the controls 21 and 23 may be of the same type which are used in the automatic sprinkler controller designated HR5 manufactured by Hydro-Rain, Inc., of San Juan Capistrano, California.

The front plate 29 has an arcuate aperture or slot 41. The terminals **19*a*–19*g* and a common terminal 40 are mounted on the front plate and, in the embodiment illustrated, are in the form of screws. Each item being controlled by the controller is coupled to one of the terminals 19*a*–19*g* and to the common terminal 40**.

The hour-select controls 23 include a disc 43 which can be manually rotated by the dial 39. The selector 15 is carried by the disc 43 and is rotatable therewith. The disc 43 is also continuously rotated by the motor 17 through a gear reduction unit 45. The motor 17 is mounted on the back plate 31 and drives the selector 15 in the same manner as the model HR5 identified above.

The motor 17, in the embodiment illustrated, is electrical; however, it may be a spring wound clock motor or any other power source capable of continuously rotating the disc 43 at a constant speed. The speed of rotation of the disc 43 can be selected depending upon the kind of operation which is to be controlled. In the case of automatic sprinkler controls, the disc 43 may rotate at 1 revolution per day.

The selector 15 is constructed of an electrically conductive material, such as a metal, and is resilient. The selector 15 is electrically connectible to the controls 23 and 21 and the source 25 in any suitable manner, such as in the manner embodied in the model HR5 identified above.

The controller 11 differs substantially from the model HR5 in the construction and arrangement of the contacts **13*a*–13*g* (FIGS. 3–7). Each of the contacts 13*a*–13*g* forms a portion of a contact assembly 47 of which the contact 13*a* forms a portion, all of the contact assemblies are identical. Although the contact assemblies 47** could be of other configurations, in the embodiment illustrated, each of them forms a segment of a circle.

Figure 6:
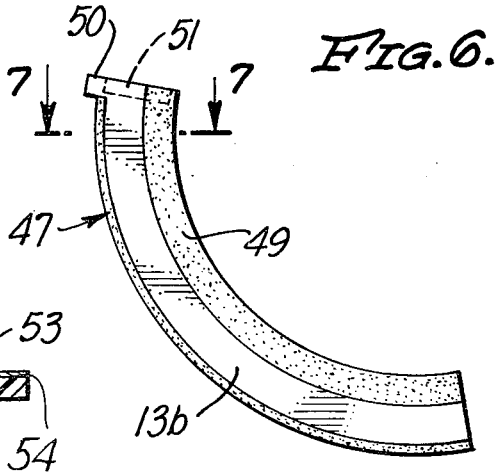
FIG. 6 is a bottom plan view of one of the contact assemblies.
Figure 7:
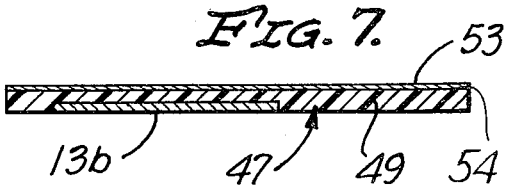
FIG. 7 is an enlarged fragmentary view taken generally along line 7—7 of FIG. 6.

Each of the contact assemblies 47 includes a contact insulator in the form of a contact carrier 49 constructed of a suitable electrical insulating material, such as a molded plastic material. As shown in FIG. 6, the contact 13*b* is mounted on and carried by the contact carrier 49. Although the contact 13*b* may be of different constructions, in the embodiment illustrated, it is in the form of a metal foil, such as phosphor-bronze foil, and it is adhered to one face of the carrier. Each of the contacts 13*a*–13*g* has a terminal 50. Each of the carriers 49 has a tab or projection 51 which extends perpendicularly away from the carrier and which projects from the face of the carrier which does not have the contact thereon.

All of the contact assemblies 47, except for the contact assembly which includes the contact 13*a*, has timing indicia 53 on the face of the carrier 49 opposite the associated contact. The timing indicia 53 is sized and arranged to indicate the length of time which each of the circuits is to be selected. The timing indicia carried by the contact assemblies 47 associated with the contacts 13*a*–13*f* carries the timing indicia for the contacts 13*b*–13*g*, respectively. The timing indicia 53 is visible through the slot 41. Although the timing indicia 53 may be provided in different ways, in the embodiment illustrated, it is provided on a separate paper strip 54 adhered to one face of the contact carrier 49. Alternatively, the timing indicia can be embossed on the contact carrier 49. Thus, except for the absence of the timing indicia 53 on the contact carrier 49 for the contact 13*a*, all of the contact assemblies 47 are identical.

The contact assemblies 47 and the associated contacts 13*a*–13*g* are mounted on the rear face of the front wall 29 for movement relative to each other and relative to the front wall along an arcuate path from a relatively stacked condition to a relatively fanned-out condition. Although this can be accomplished in different ways, in the embodiment illustrated, the contact assemblies 47 are sandwiched between the rear face of the front plate 29 and a mask 55 which is attached to the front plate in any suitable manner. The mask 55 is constructed from a rigid, electrical insulating material and, in the embodiment illustrated, takes the form of a relatively large segment of an annulus in that it extends over approximately 270 degrees. The radii of the contact assemblies 47 and the mask 55 are identical.

Figure 3:
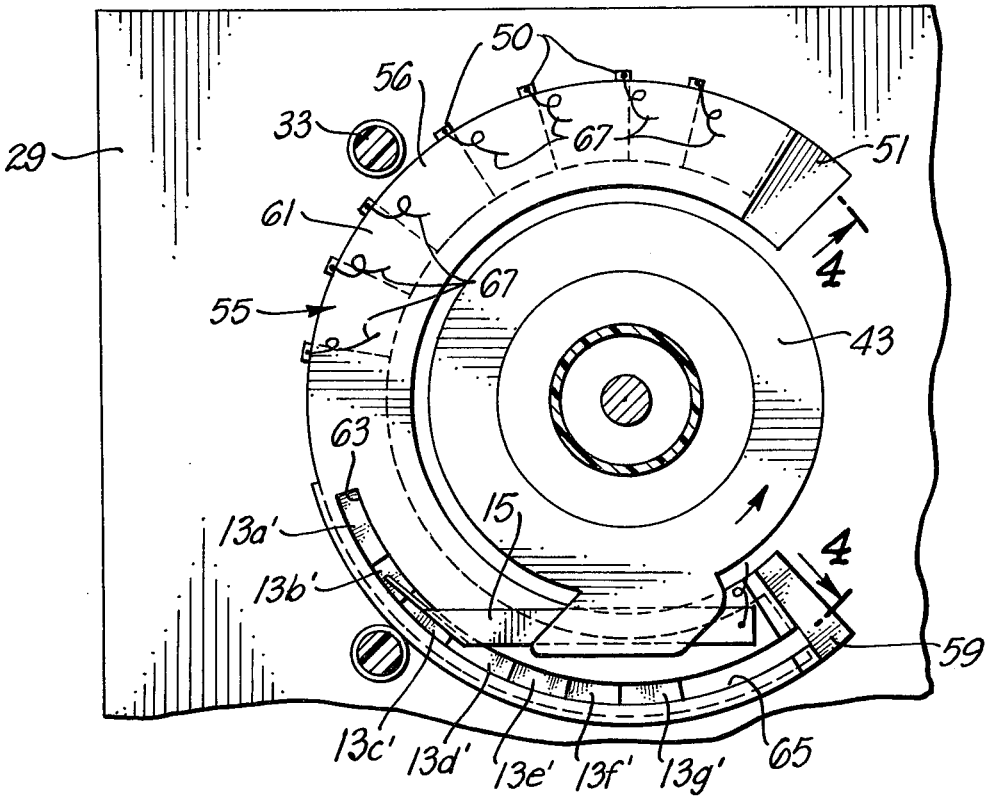
FIG. 3 is an enlarged fragmentary view taken generally along line 3—3 of FIG. 2.
Figure 4:
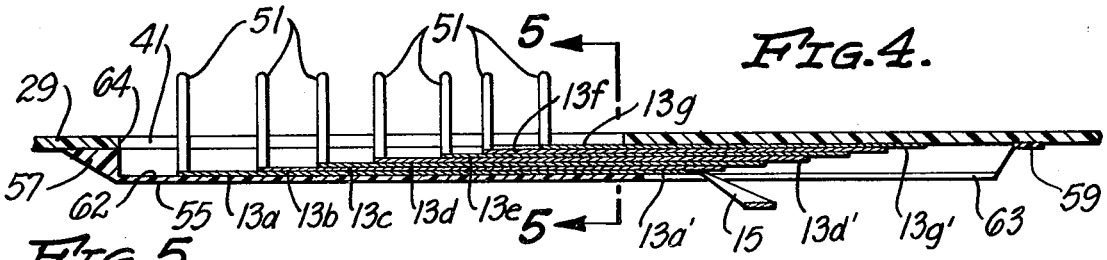
FIG. 4 is an enlarged fragmentary sectional view taken generally along line 4—4 of FIG. 3.
Figure 5:
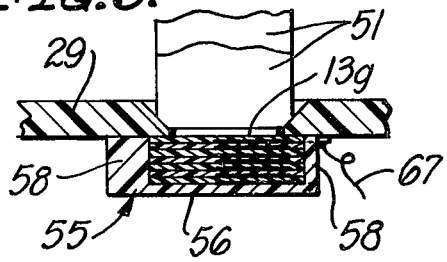
FIG. 5 is an enlarged fragmentary sectional view taken generally along line 5—5 of FIG. 4.

The mask 55 has opposite side walls 58 (FIGS. 3 and 5) to laterally guide the contact assemblies 47 and a bottom wall 56 below the contact assemblies. The side walls 58 need not extend for the full length of the mask 55. The wall 56 of the mask 55 has a leading end portion which is inclined away from the front plate 29 in the direction of rotation of the selector 15 to form a cam or ramp 57 (FIG. 3). The wall 56 has another end portion 59 (FIG. 3) which is suitably attached to the rear face of the front plate 29. A continuous portion 61 of the wall 56 extends from the ramp 57 to a slot or aperture 63 so as to cover and enclose portions of the contacts 13*a*–13*g*. The slot 63 forms a segment of an annulus, is coaxial with the axis of rotation of the selector 15, and is adapted to have the selector extend therethrough as the latter rotates. The length of the slot 63 corresponds to the total cycle time during which the controller can select one of the contacts 13*a*–13*g*. Of course, the length of the slot 63 can be selected in accordance with the desired total cycle time. Timing indicia 62 for the contact 13*a* (FIGS. 1 and 2) is provided on the upper face of the wall 56 in line with the slot 41 in the same manner that timing indicia is provided on the carriers 49.

The contact assemblies 47 are arranged in a stack between the front plate 29 and the mask 55. Each of the contact assemblies 47 is oriented so that the associated contact faces away from the front plate 29, i.e., downwardly as viewed in FIG. 4, and the timing indicia 53 faces toward the front plate 29, i.e., upwardly as viewed in FIG. 4. The tabs 51 project away from the mask 55 and through the aperture 41 in the front plate 29 so that they can be readily manually grasped from the forward side of the front plate 29. The tabs 51 also maintain the contacts 13*a*–13*g* in the selected order. In the embodiment illustrated, the tab 51 for the lowermost contact, i.e., the contact 13*a* is nearest an end 64 (FIGS. 1 and 4) of the aperture 41.

In the fully stacked condition, the contact assemblies overlie each other beneath the continuous portion 61 of the mask 55. In this event, no portions of the contacts 13*a*–13*g* are exposed through the slot 63.

However, the contact assemblies 47 are movable so that virtually any portions of the contacts 13*a*–13*g* can be exposed to the selector 15 via the slot 63. As shown by way of example in FIGS. 3 and 4, each of the contacts 13*a*–13*g* has an exposed end portion 13*a*′–13*g*′. As shown by way of example in FIGS. 3 and 4, the exposed end portions 13*a*′–13*g*′ are contiguous and of different lengths. An end portion 65 of the slot 63 has no contact exposed therein. Accordingly, with this arrangement, the portion of the cycle time represented by the end portion 65 is not being used, and the balance of the cycle time is divided up among the contacts 13*a*–13*g* in accordance with the relative lengths of the exposed end portions 13*a*′–13*g*′. Leads 67 (FIG. 3) are suitably coupled to the terminals 50 of the contacts 13*a*–13*g* and to the terminals 19*a*–19*g*, respectively. Thus, whenever power is provided to the selector 15, a circuit can be established from the power source through the selector and selected contact to the associated terminal.

In use, the day-select controls 21 and the hour-select controls 23 are manually set to select the days and the hour during the selected days during which irrigation is desired. The available cycle time is divided up by moving the tabs 51 to adjust the lengths of the exposed end portions 13*a*′–13*g*′. If a station is to be skipped, the corresponding contact 13*a*–13*g* is positioned so that none of it is exposed in the slot 63.

The motor 17 is then started and run continuously at constant speed to rotate the disc 43 and the selector 15 counterclockwise as viewed in FIG. 3. The selector 15 is resilient and is cammed upwardly by the ramp 57 as it moves over the ramp. The continuous portion 61 of the mask 55 insulates the selector 15 from the contacts 13*a*–13*g* while the selector is sliding along the continuous portion. When the selector reaches the slot 63, it extends through the slot and sequentially engages the exposed contiguous end portions 13*a*′–13*g*′.

If the controls 21 and 23 are closed to permit electrical energy to flow from the source 25 to the selector 15, then a circuit is established to the selected contact 13*a*–13*g*, i.e., the contact which is in engagement with the selector. This circuit is selected for so long as the selector engages that contact. In this manner, electrical energy is sequentially provided to the terminals 19*a*–19*g* for a period of time corresponding to the relative lengths of the exposed portions 13*a*′–13*g*′, respectively.

The available cycle time which is represented by the length of the slot 63 can be divided up in any desired way among the contacts 13*a*–13*g*. For example, the exposed portions 13*a*′–13*e*′ could be very short and represent only a very small portion of the cycle time, and the exposed portion 13*f*′ could be very long and take up substantially all of the available cycle time, and the contact 13*g* may have no exposed portion and be skipped entirely. It is important to note that regardless of how the cycle time is divided, the exposed portions are contiguous so the selector passes from one of the exposed portions 13*a*′–13*g*′ directly to the next exposed portion in the sequence, and there is no gap or deadband between the exposed portions. Consequently, the irrigation functions or other functions are carried out in immediate consecutive order without intervals therebetween.

Although an exemplary embodiment of the invention has been shown and described, many changes, modifications and substitutions may be made by one having ordinary skill in the art without necessarily departing from the spirit and scope of this invention.

I claim:

1. An automatic controller comprising:

a supporting structure;

a plurality of circuits mounted on said supporting structure;

a plurality of adjustable contacts, each of said adjustable contacts being in at least one of said circuits;

a selector for sequentially selecting said circuits;

means for mounting the selector on the supporting structure;

means for relatively moving the selector and said adjustable contacts along a path at substantially constant speed whereby the selector and the contacts can be brought into engagement sequentially to sequentially select said circuits; and means for mounting the adjustable contacts on the supporting structure to permit selectively adjusting the length of each of such contacts that is exposed to the selector along said path while maintaining the exposed portions contiguous whereby the length of time of engagement between the selector and each of the exposed portions of the contacts can be adjusted without introducing significant gaps between the exposed portions of the contacts during which the selector would not engage any of said exposed portions of said contacts.

2. A controller as defined in claim 1 wherein the region of said path over which the selector can engage the exposed portions of said adjustable contacts has a length equal to L and there are N of said adjustable contacts, and said contact mounting means permits the selective adjustment of said adjustable contacts so that at least one of said adjustable contacts may have an exposed portion along said path which is greater than L÷N whereby the circuit containing said one adjustable contact can be selected for longer than 1/N of the time that the selector can engage the adjustable contacts.

3. A controller as defined in claim 1 wherein said contact mounting means permits the adjustment of the adjustable contacts so that at least one of said adjustable contacts may have no exposed portion along said path whereby the selector will not engage such contact along said path and the circuit containing such contact will not be selected.

4. A controller as defined in claim 2 wherein said contact mounting means permits the adjustment of the adjustable contacts so that at least one of said adjustable contacts may have no exposed portion along said path whereby the selector will not engage such contact along said path and the circuit containing such contact will not be selected.

5. An automatic controller as defined in claim 1 wherein said for relatively moving means continuously and repeatedly moves the selector and the adjustable contacts relative to each other along said path with each time over said path constituting a cycle, said controller including means for selecting on which of said cycles electrical energy will be supplied to the selected circuits.

6. An automatic controller as defined in claim 1 wherein said contact mounting means mounts the adjustable contacts on the supporting structure for movement relative to each other along said path from a relatively stacked condition to a relatively fanned-out condition in which each adjustable contact can project beyond at least one adjacent adjustable contact a variable amount whereby the length of exposure of each adjustable contact along said path can be adjusted.

7. An automatic controller comprising:

a supporting structure;

a plurality of circuits on said supporting structure;

a plurality of adjustable contacts, each of said adjustable contacts being in one of said circuits;

means for mounting said adjustable contacts on the supporting structure for movement relative to each other along a path from a relatively stacked condition to a relatively fanned-out condition in which each adjustable contact can project beyond at least one adjacent adjustable contact a variable amount whereby the extent of exposure of each adjustable contact along said path can be adjusted;

a selector;

means for mounting the selector on the supporting structure; and means for relatively moving the selector and said contacts along said path to sequentially bring the selector into engagement with the exposed portions of the contacts to sequentially select the circuits containing said exposed portions of said adjustable contacts whereby the length of time each of such circuits is selected can be varied by adjusting the exposure of said adjustable contacts.

8. An automatic controller as defined in claim 7 including a contact carrier of insulating material, one of said adjustable contacts being joined to said contact carrier, said contact carrier electrically insulating said one adjustable contact from a first adjacent adjustable contact.

9. An automatic controller as defined in claim 8 including timing indicia on the contact carrier for providing an indication of the length of the exposed portion of a second of said adjustable contacts.

10. An automatic controller as defined in claim 7 wherein said adjustable contacts are stacked in said fanned-out condition with the end portions of at least some adjustable contacts extending out of the stack to define said exposed portions of the adjustable contacts.

11. An automatic controller as defined in claim 7 including a mask mounted on said supporting structure, said adjustable contacts being stacked between the supporting structure and the mask, said mask having an elongated slot therein, said exposed portions of said adjustable contacts being exposed through said slot, said selector being adapted to engage said exposed portions of said adjustable contacts through said slot.

12. An automatic controller as defined in claim 7 wherein said path is arcuate and said contacts are arcuate, and said means for relatively moving rotates the selector relative to the supporting structure along said path.

13. An automatic controller as defined in claim 7 wherein said exposed portions of said adjustable contacts are contiguous along said path in said fanned-out condition whereby the selector contacts one of the exposed portions immediately after the previous exposed portion without contacting any significant gap between such exposed portions.

14. An automatic controller as defined in claim 7 wherein said means for relatively moving includes motor means for moving the selector at a substantially constant speed relative to said supporting structure and said adjustable contacts, electrical insulating means on at least some of said adjustable contacts for electrically insulating the contacts from each other, timing indicia on at least some of said insulating means for providing an indication of the length of some of said exposed portions.

15. An automatic controller as defined in claim 7 wherein said supporting structure includes a plate having an arcuate slot therein, said adjustable contacts being arcuate and arranged on one side of said plate, said path is arcuate, said means for relatively moving rotates the selector at substantially constant speed on one side of said plate along said arcuate path, said automatic controller including a plurality of electrical insulators coupled respectively to at least some of said adjustable contacts for insulating the contacts from each other, timing indicia on at least some of said electrical insulators, and tabs coupled to each of said adjustable contacts and projecting through said arcuate slot in said plate to facilitate manual adjustment of said adjustable contacts to vary the lengths of the exposed portions thereof.

* * * * *